United States Patent [19]

Dromboski

[11] 4,083,457

[45] Apr. 11, 1978

[54] UNIVERSAL BRACKET APPARATUS FOR SUPPORTING A PLURALITY OF FLOWERPOTS

[76] Inventor: Michael Dromboski, 361 Independence Ave., Trenton, N.J. 08610

[21] Appl. No.: 719,461

[22] Filed: Sep. 1, 1976

[51] Int. Cl.[2] ..... A47G 29/00

[52] U.S. Cl. ..... 211/71; 47/39; 47/67; 248/311.1 R

[58] Field of Search ..... 47/39, 40, 44–47, 47/67; D6/114, 125, 137; 211/88, 71, 163, 62, 63, 71–75, 113, 118, 119, 115, 18, 47, 48, 63, 88, 89, 74, 75, 107; 248/200, 222, 305, 311, 220.1, 220.2, 222.1, 222.2, 222.3, 222.4, 226.1, 226.2, 226.3, 229, 230, 311–313, 241, 218.4, 219.1, 219.4

[56] References Cited

U.S. PATENT DOCUMENTS

| | | | |
|---|---|---|---|
| 1,112,558 | 10/1914 | Red | 47/39 X |
| 1,741,136 | 12/1929 | Naylor | 248/311.1 |
| 1,803,508 | 5/1931 | Rossman | 248/229 X |
| 1,854,478 | 4/1932 | Meyers | 248/230 |
| 2,528,604 | 11/1950 | McHollan | 248/320 X |
| 2,530,456 | 11/1950 | Fracchia | 47/67 X |
| 3,091,342 | 5/1963 | Crump | 211/71 |
| 3,194,524 | 7/1965 | Trumbull | 248/229 X |
| 3,310,911 | 3/1967 | Boser et al. | 47/39 |
| 3,702,591 | 11/1972 | Banse | 248/241 |
| 3,747,268 | 7/1973 | Linder | 47/39 X |
| 3,818,633 | 6/1974 | Sable | 47/67 |

FOREIGN PATENT DOCUMENTS

| | | | |
|---|---|---|---|
| 607,482 | 12/1925 | France | 47/67 |
| 296,279 | 4/1954 | Switzerland | 47/46 |
| 570,756 | 11/1974 | Switzerland | 47/47 |

*Primary Examiner*—Edgar S. Burr
*Assistant Examiner*—James R. Feyrer
*Attorney, Agent, or Firm*—Arthur L. Plevy

[57] ABSTRACT

There is disclosed a bracket arrangement adapted to support a plurality of flowerpots or similar articles. The bracket comprises an integral member fabricated from a flexible material having a horizontal central portion located between two arcuate end portions, each end portion terminating in an opened circular loop with a traverse arm extending from said central portion, said central portion having an extending projection relatively centrally located thereon and at least two apertures located on said central portion on either side of said projection to enable the coupling of an additional bracket of a mirror-image configuration to said bracket to form a composite bracket configuration having a pole accommodating coupling means formed by the coaction of said extending projections.

9 Claims, 7 Drawing Figures

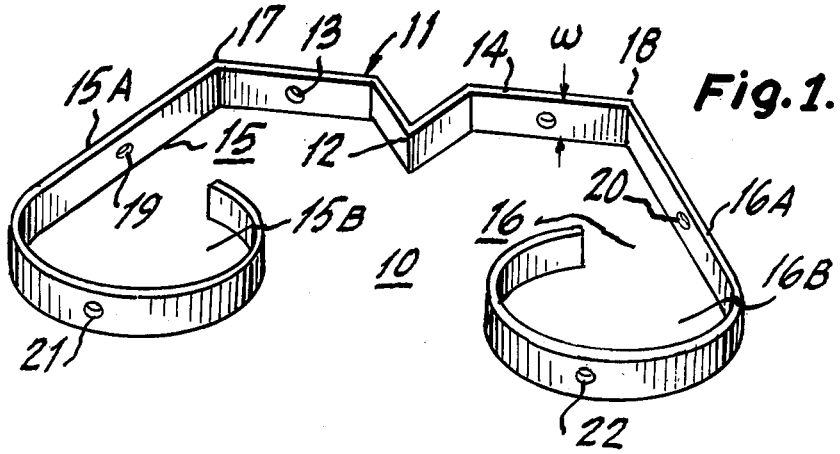
Fig. 1.
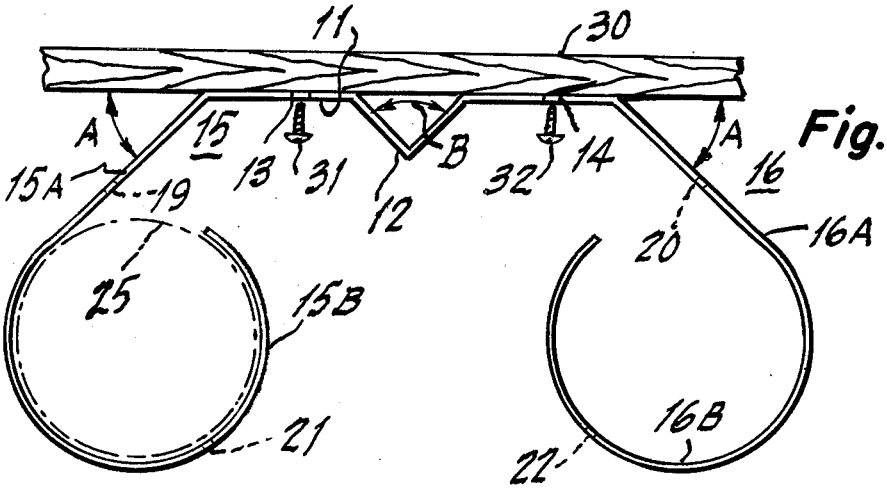
Fig. 2.
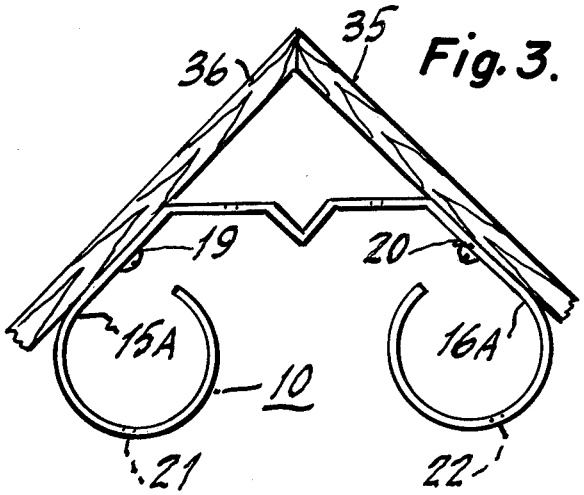
Fig. 3.
Fig. 4.
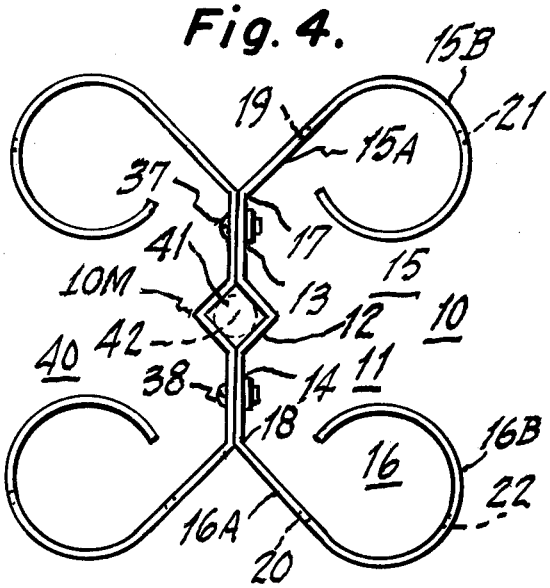

Fig. 5.
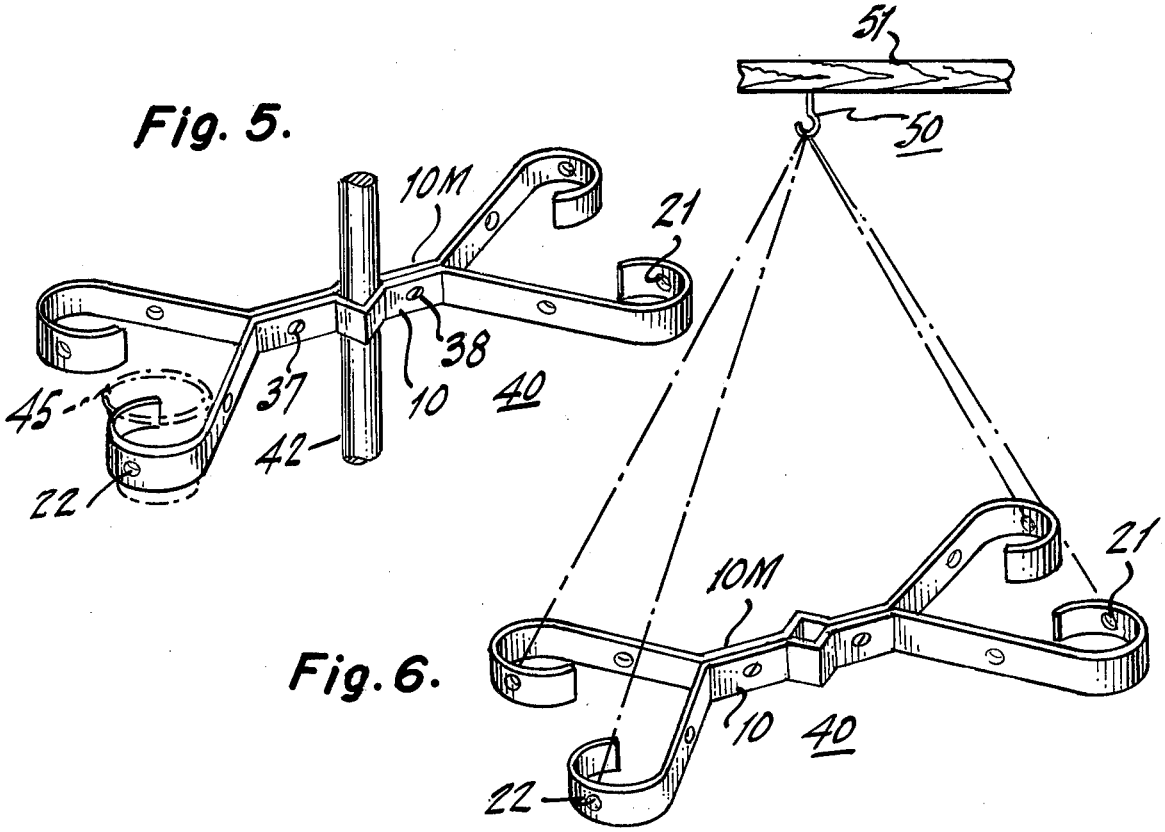
Fig. 6.
Fig. 7.
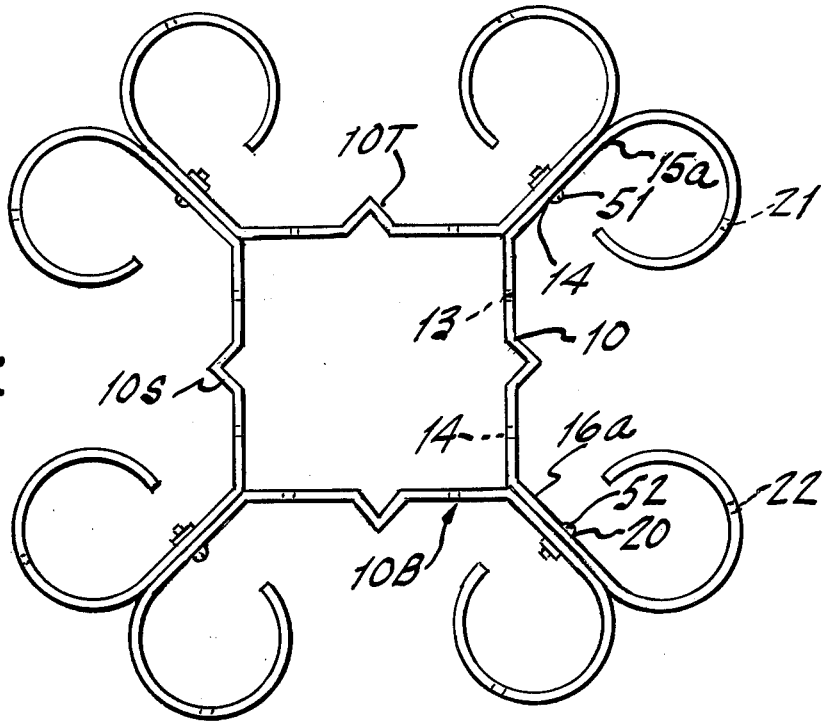

UNIVERSAL BRACKET APPARATUS FOR SUPPORTING A PLURALITY OF FLOWERPOTS

BACKGROUND OF INVENTION

This invention relates to a bracket for supporting a flowerpot and more particularly to a bracket of a shaft enabling simplified coupling of like brackets to form a plurality of support assemblies.

House plants such as flowers and so on are and have been used extensively in the home for decorative purposes as well as for their environmental value. Commonly such plants are grown in flowerpots and are placed throughout a home or a room to enhance the beauty of the premises. As such, many types of supports and holders exist in the prior art for positioning or supporting a flowerpot and its associated plant on a wall, floor or suspended from the ceiling. Such holders incorporate a flowerpot accommodating structure and attempt to facilitate adjustment of the potted plant as well as attempting to make the bracket simple and easy to construct and maintain.

Thus the prior art discloses a plurality of such patents which depict supports and brackets of various types.

A perusal of such art discloses patents as U.S. 1,603,641 entitled VASE HOLDER issued on Oct. 19, 1926 to A. M. Richards and depicting a vase holder which comprises a bracket assembly including an upper and lower ring for holding a tapered cylindrical vase. Other patents as U.S. Pat. Nos. 1,930,673 and 2,025,707, both entitled FLOWERPOT HOLDER and both issued to A. Consolazio show adjustable pot holder assemblies for holding and supporting flowerpots on a wall or elsewhere. Other patents as U.S. Pat. Nos. 2,732,954, 2,794,554, 2,927,700 depict various other types of supports, stands and structures for maintaining or supporting flowerpots in a home, office or other environment.

Certain of the prior art devices are relatively complicated, difficult to construct and are not readily adaptable for alternate uses.

It is therefore an object of this invention to provide an improved bracket arrangement which due to its construction, is adaptable to support a plurality of flowerpots in various aesthetic positions and locations, with a minimum of construction time involved in forming such arrangements.

BRIEF DESCRIPTION OF PREFERRED EMBODIMENT

A bracket configuration adapted to support a plurality of flowerpots or similar articles comprising an integral member fabricated from a flexible material having a relatively horizontal central portion, a right and a left extending arm portion directed transversely from said central portion and each terminating in an arcuate end portion consisting of a loop dimensioned to encircle a flowerpot, whereby at least two flowerpots can be accommodated by said bracket as each is capable of being encircled and hence retained within said arcuate end portions.

BRIEF DESCRIPTION OF FIGURES

FIG. 1 is a perspective view of a bracket according to this invention also depicting a dashed line view of an alternate configuration.

FIG. 2 is a top view of the bracket of FIG. 1 mounted on a wall.

FIG. 3 is a top view of a bracket mounted in a corner.

FIG. 4 is a top view of a composite bracket assembly formed by the coupling of two brackets.

FIG. 5 is a perspective view of a composite bracket assembly secured to a pole.

FIG. 6 is a perspective view of a composite bracket assembly suspended from above.

FIG. 7 is a top plan view of a bracket configuration employing four brackets of this invention secured together.

DETAILED DESCRIPTION OF THE FIGURES

Referring to FIG. 1, there is shown a bracket 10, which is preferably formed from an integral metallic strip. The bracket 10 may be formed from a suitable flexible metal as steel, aluminum and so on or a relatively flexible plastic.

As indicated, the bracket 10 is formed from an integral piece of metal and bent to assume the configuration depicted in FIG. 1. The bracket 10 essentially consists of a central portion 11 which is relatively horizontal. The width (*w*) of the entire bracket may be between ¼ to 2 or more inches, depending upon the flowerpot or article to be accommodated and the metal strip is of a thickness less than its width as shown. The central portion 11 has a projecting extension 12 relatively centrally located. On either side of the projection 12 are two fastener accommodating apertures as 13 and 14 and are used to permit the coupling of identical brackets as 10 one to the other for form various useful arrangements, as will be explained.

Depending from the central portion 11 are a right and a left handed transverse extending arm designated as 15 and 16 The arms as extending from the central portion 11 have a first section as **15*a* and 16*a* which are direct along a 45° angle with the horizontal and commencing at the bend lines 17 and 18. The outer ends of the extending arms are arcuately bent or formed in a smooth circular configuration to form an open looped portion as 15B and 16B. The loops 15B and 16B are shown as directed inwardly from the extending arms 15*a* and 16*a*, but can be directed outwardly (dashed line) if desired. Generally, the loops or the arcuate ends of the bracket are formed of a diameter to accommodate conventional sized flowerpots, and hence can be of any suitable diameter. The loops 15B and 16B** are open ended to permit the user to bend or adjust the flexible metal to accommodate the loop to encircle a portion of the periphery of a typical flowerpot.

Also present on the surface of the extending arms **15*a* and 16*a* are apertures 19 and 20 for accommodating various fasteners, as will be explained and apertures 21 and 22 located respectively on the arcuate ends 15B and 16B** for accommodating a chain or a cord to enable one to suspend a bracket assembly from a ceiling of a room or from a cantilever or other extension, as will be shown.

FIG. 2 shows a top plan view of the bracket 10 to more clearly depict the nature of the configuration in regard to the particular bends and angles involved. As indicated, there is an extending projection 12 located on the central portion 11 which is a V shaped extension formed at an angle B of approximately ninety degrees. The extending arms **15*a* and 16*a* are directed from the central portion 11 at an angle A of approximately 45° and, of course, terminate in the inward arcuate open looped portions 15B and 16B. Shown in phantom in FIG. 2 is a top view of a flowerpot 25 retained and encircled partially by the loop 15B. It is understood that a similar flowerpot could be accommodated by the loop 16B on the right side of the bracket 10**.

Thus, as should be readily apparent, one could mount the bracket 10 upon a wall or flat surface 30 by securing the bracket 10 to the wall 30 by means of conventional fasteners as screws, nails and so on, generally depicted as fasteners 31 and 32. In such a use, the bracket 10 would then simply and easily support two flowerpots as 25 which can be replaced or removed as desired due to emplacement of the pots within the arcuate loops 15B and 16B.

Referring to FIG. 3, there is shown a top view of a bracket 10 mounted in a corner formed by two walls as 35 and 36. Due to the angles of the extending arm portions 15*a* and 16*a* of the bracket 10, the bracket can be mounted as shown. The bracket 10 is secured to each wall via the associated aperture as 19 and 20 in the extending, angled arm portions 15*a* and 16*a*. Thus, the bracket 10 cannot only be mounted on a single wall or flat surface as 30 in FIG. 2, but can also be mounted in a corner formed by two walls as 35 and 36 as shown in FIG. 3.

Shown in FIG. 4 is a right bracket 10 which is identical to the bracket depicted above and therefore the same numerals have been retained. The bracket 10 is shown coupled to an identically formed bracket 10M which is essentially the inverted or mirror image of bracket 10. Thus, brackets 10M and 10 are the same configuration, but are positioned one with respect to the other as shown in FIG. 4 and are coupled together by means of the corresponding apertures 13 and 14 associated with the central portion 11 of the brackets and held together by means of typical bolt assemblies as 37 and 38. As can be ascertained, one now has a composite bracket assembly 40 which can accommodate four flowerpots, one located and encircled by each arcuate loop as 15B and 16B.

As shown in FIG. 4, the extending angular projection portion as 12 located on the central portion 11 of the bracket, forms a central square or rectangular aperture 41, due to the coupling of the brackets 10 and 10M. This aperture 41 is dimensioned to encircle a pole such as a pole associated with a lamp or otherwise. The brackets 10 and 10M prior to insertion of the bolts 37 and 38 would be emplaced about the pole 42 as shown and then secured by means of bolts 37 and 38, thus retaining the composite bracket assembly 40 about the pole. This therefore, enables the emplacement of such brackets about a decorative pole in a home or office. The pole 42 as indicated, may be associated with a pole lamp, a staircase pole and so on, enabling one to couple the composite assembly at other locations besides a wall or a corner.

FIG. 5 is a perspective view of the composite bracket 40 thus coupled to a pole structure 42 wherein one arcuate loop is encircling a flowerpot 45 to more clearly depict the utility and operation of the apparatus.

FIG. 6 shows still another utility of the composite bracket 40. As is known, a great many fixtures or bracket assemblies exist for suspending a flowerpot or similar article from a ceiling. FIG. 6 shows the composite bracket 40 hung from a bolt assembly 50, secured in a ceiling or overhang 51. The bracket 40 is thus suspended by means of four cords, strings or chains, each associated and coupled to the apertures as 21 and 22 located on the arcuate loop ends of the bracket 10 and 10M. Due to the angular extending arms, the composite suspended assembly is relatively stable and balanced in the suspended position.

Shown in FIG. 7 is still another configuration which can be simply formed employing four identical brackets designated as 10, 10T, 10S and 10B. The brackets are coupled together via a nut and bolt assembly 51 and 52 positioned within the apertures as 19 and 20 on the extending arm sections as 15*a* and 16*a*.

The entire arrangement can be suspended by means of suitable chains or cords using the apertures 21 and 22 on the brackets as 10 or apertures 13 and 14. The configuration depicted in FIG. 7 can accommodate eight separate flowerpots.

Other configurations and arrangements can be implemented accordingly due to the universal nature of the bracket configuration.

Other shaped pots or pots of varying diameter can be accommodated due to the open looped portions of the bracket as the material of the bracket being flexible, is capable of being easily adjusted to accommodate different sized and shaped pots.

In summation, a bracket configuration is provided which enables the retension of a flowerpot in each of two arcuate loops associated with the bracket. The bracket includes suitable apertures on the surface thereof to enable coupling of one of more brackets to others to form a plurality of useful configurations to accommodate a number of desireable mounting techniques for displaying a plurality of accommodated flowerpots by any one of said configurations.

I claim:

1. A bracket arrangement adapted to support a plurality of flowerpots or similar articles, comprising:

a first integral, flexible, planar bracket member having a relatively horizontal central portion located between two arcuate end portions, each end portion terminating in a opened circular loop and directed towards said central portion with a transverse extending arm, each directed at an angle of 45° with respect to said central portion, wherein said circular loops are within the same plane as said horizontal central portion as extending therefrom, said central portion including a V shaped projection extending in the same direction as said transverse arms and at least two apertures located on said central portion, one on either side of said projection to enable the coupling of a corresponding identical bracket of a mirror image configuration to said first bracket by means coacting with said apertures to form a composite bracket having a central aperture formed by said corresponding projection, to enable the coupling of said composite bracket to a pole assembly.

2. The bracket arrangement according to claim 1, further including means coupled to said composite bracket assembly for suspending said bracket from a ceiling.

3. A bracket apparatus for supporting a plurality of flowerpots or similar articles, comprising:

an integral flexible planar member having a relatively horizontal central portion, said horizontal portion having a left and a right side, a right and a left transversely extending arm, each directed from said right and left sides of said central portion at the same given angle of 45° with respect to said central portion, each of said extending arms terminating in an open circular loop arcuate end portion, said arcuate end portion dimensioned to encircle a portion of the periphery of a flowerpot to retain said flowerpot therein, and means associated with said bracket to retain the same in a supporting position, said central portion including a relatively central extending projection of a V shape and adapted to form a central pole accommodating aperture when a corresponding mirror image congruent bracket is coupled to said bracket as said central portion.

4. The bracket according to claim 3 wherein said central portion includes at least one aperture thereon adapted to accommodate a fastening means.

5. The bracket according to claim 3 wherein said extending arm include at least one aperture adapted to accommodate a fastening means.

6. The bracket according to claim 3 wherein each of said arcuate end portions includes at least one aperture adapted to accommodate a fastening means.

7. The bracket according to claim 3, wherein said open circular loops arcuate end portions are located in the same plane as said horizontal central portion with said open portion of said circular loops arcuate end portions closest to said central portion.

8. The bracket according to claim 3 wherein said integral flexible member is fabricated from steel.

9. A bracket to support a plurality of flowerpots or similar articles, comprising:

an integral flexible planar member having a horizontal central portion, a first transverse arm directed from a first end of said central portion at a given angle of 45° to cause said arm to extend away and project beyond said central portion, said arm terminating in an arcuate inwardly formed first open loop positioned between said central portion and said first extending arm, and a second transverse arm directed from a second end of said central portion at the same angle of 45° as said first arm to cause said second arm to extend away and project beyond said central portion, said second arm terminating in a corresponding arcuate inwardly formed open loop positioned in the same plane as said first loop and between said central portion and said second extending arm, each of said loops adapted to accommodate a flowerpot by incircling the periphery thereof, and means associated with said bracket for securing said bracket to a supporting structure, said means including a V shaped projection located on said central portion, with the angle of said V at relatively ninety degrees and adapted to form a central pole accommodating aperture when a corresponding congruent bracket is coupled to said bracket at said central portion.

* * * * *